US007819707B2

(12) United States Patent
Aoki et al.

(10) Patent No.: US 7,819,707 B2
(45) Date of Patent: Oct. 26, 2010

(54) ELECTRICAL CONNECTION STRUCTURE

(75) Inventors: Kazuo Aoki, Anjo (JP); Hiromichi Agata, Nisho (JP); Tatsuyuki Uechi, Toyouke (JP); Tomoo Atarashi, Kariya (JP); Natsuki Sada, Anjo (JP); Masahiro Tanae, Okazaki (JP); Manabu Miyazawa, Anjo (JP); Isao Fujishima, Anjo (JP); Daisuke Iimura, Takahama (JP)

(73) Assignee: Aisin AW Co., Ltd., Anjo (JP)

( * ) Notice: Subject to any disclaimer, the term of this patent is extended or adjusted under 35 U.S.C. 154(b) by 0 days.

(21) Appl. No.: 12/585,940

(22) Filed: Sep. 29, 2009

(65) Prior Publication Data

US 2010/0105253 A1 Apr. 29, 2010

(30) Foreign Application Priority Data

Oct. 29, 2008 (JP) ..... 2008-278459

(51) Int. Cl.
*H01R 4/30* (2006.01)

(52) U.S. Cl. ..... 439/801; 439/727

(58) Field of Classification Search ..... 439/801, 439/320, 327, 805, 353, 712, 722, 724, 744, 439/746, 721, 727
See application file for complete search history.

(56) References Cited

U.S. PATENT DOCUMENTS 3,052,866 A * 9/1962 Koch ..... 439/727
5,380,227 A * 1/1995 Taylor ..... 439/727
2007/0207652 A1 9/2007 Tsuruta

FOREIGN PATENT DOCUMENTS

| | | |
|---|---|---|
| JP | A-2007-221962 | 8/2007 |
| JP | A 2007-234561 | 9/2007 |
| JP | A 2007-306772 | 11/2007 |
| JP | A 2007-311123 | 11/2007 |

OTHER PUBLICATIONS

International Search Report mailed Nov. 17, 2009 for National Phase Application No. PCT/JP2009/066410.

* cited by examiner

*Primary Examiner*—Khiem Nguyen
(74) *Attorney, Agent, or Firm*—Oliff & Berridge, PLC

(57) ABSTRACT

An electrical connection structure that includes a first connection portion of the connection member that is fixedly fastened to the first terminal by a fastening bolt, and a second connection portion of the connection member that is connected to the second terminal through an insertable/removable plug, the first connection portion is fixedly fastened to the first terminal by inserting the fastening bolt through an insertion hole provided in one of the connection member and the first terminal, and fastening the fastening bolt in a fastening hole provided in the other of the connection member and the first terminal, the insertion hole is formed larger than a diameter of a shaft-like portion of the fastening bolt, and an inserting/removing direction of the plug and an axial direction of the fastening bolt are substantially parallel to each other.

20 Claims, 4 Drawing Sheets

ELECTRICAL CONNECTION STRUCTURE

CROSS-REFERENCE TO RELATED APPLICATION

The disclosure of Japanese Patent Application No. 2008-278459 filed on Oct. 29, 2008, including the specification, drawings and abstract is incorporated herein by reference in its entirety.

BACKGROUND

The present invention relates to an electrical connection structure for electrically connecting a first terminal and a second terminal by a connection member.

In recent years, electric vehicles having a rotating electrical machine as a driving force source of a vehicle, and hybrid vehicles having an engine and a rotating electrical machine have attracted attention in terms of fuel economy, environmental protection, and the like. A drive device for such vehicles requires a control device for controlling the rotating electrical machine. Terminals electrically connected to the rotating electrical machine, and terminals electrically connected to the control device are connected by connection members such as bus bars.

In general, the connecting work in such an electrical connection structure for electrically connecting two terminals is performed in the state where each device including the terminals to be connected by the connection members is fixed in a case or the like. For example, in an example of such a vehicle drive device as described above, the terminals provided in the rotating electrical machine and the terminals provided in the control device are often connected by the connection members after the rotating electrical machine and the control device are assembled in the case. In this case, the space for the connecting work may be limited depending on the arrangement of the devices, and thus, the shape of the connection members, the arrangement of the terminals, and the method for connecting the connection members and the terminals need be determined so as to ensure the workability of the connecting work.

As a technique regarding the above problem of the workability, Japanese Patent Application Publication No. JP-A-2007-221962 shown below, for example, discloses an electrical connection structure in a hybrid vehicle drive device. According to the invention disclosed therein, the direction of supplying bus bars, serving as connection members for electrically connecting an inverter to wiring members connected to a rotating electrical machine, into a case is made to be the same direction as the working direction of screwing the bus bars into the inverter and the wiring members, whereby the attaching work of the bus bars can be facilitated.

SUMMARY

A connection member needs not only to ensure the above workability, but also to be able to absorb errors regarding the dimensions of the connection member and the attachment position of each terminal. If the connection member cannot absorb the errors, the connection member is subjected to a load such as a bending stress in the case where the connection member is a member that is less likely to deform, such as a copper plate having a certain degree of thickness. Moreover, a terminal supporting the connection member is also subjected to the load. This stress becomes a problem especially in the case of devices that are used in harsh conditions regarding vibration as compared to common devices, such as the above drive devices used in the mounted state in a vehicle. This is because vibration resistance of the connection member is reduced in the state where a stress is generated in the connection member.

However, in the structure as shown in Japanese Patent Application Publication No. JP-A-2007-221962, the tolerance regarding the dimensions of the bus bars, and the tolerances regarding the attachment positions of the wiring members connected to the inverter and the rotating electrical machine, especially the tolerances in the axial direction of bolts used for screwing, need to be strict. That is, errors regarding the dimensions of the bas bars and the attachment positions of the terminals in the axial direction of the bolts can hardly be absorbed, and the attaching work of the bus bars becomes difficult if errors are generated. Moreover, if the bus bars are forcibly attached when errors that are too large to be absorbed are generated, the bus bars are bent, for example, and thus, a bending stress is generated in the bus bars. Thus, in such a structure as described in Japanese Patent Application Publication No. JP-A-2007-221962, the above tolerances in the axial direction of the bolts need to be very strict, thereby increasing the cost.

The present invention has been developed in view of the above problems, and it is an object of the present invention to provide an electrical connection structure for electrically connecting a first terminal and a second terminal by a connection member, which is capable of ensuring excellent workability, and is capable of implementing absorption of errors regarding the dimensions of the connection member and the attachment position of each terminal by using a simple structure.

In an electrical connection structure for electrically connecting a first terminal and a second terminal by a connection member according to a first aspect of the present invention, a characteristic structure of the electrical connection structure for achieving the above object lies in that: a first connection portion of the connection member is fixedly fastened to the first terminal by a fastening bolt, and a second connection portion of the connection member is connected to the second terminal through an insertable/removable plug; the first connection portion is fixedly fastened to the first terminal by inserting the fastening bolt through an insertion hole provided in one of the connection member and the first terminal, and fastening the fastening bolt in a fastening hole provided in the other of the connection member and the first terminal; the insertion hole is formed larger than a diameter of a shaft-like portion of the fastening bolt; and an inserting/removing direction of the plug and an axial direction of the fastening bolt are substantially parallel to each other.

Errors may be generated in the dimensions of the connection member and the attachment positions of the first terminal and the second terminal, depending on the processing accuracy of a processing machine, or the like. According to the above characteristic structure, the insertion hole for the fastening bolt, which is provided in one of the connection member and the first terminal, is formed larger than that of the shaft-like portion of the fastening bolt. Thus, the errors regarding the dimensions of the connection member and the attachment positions of the first terminal and the second terminal in a direction that is parallel to a plane perpendicular to the axial direction of the fastening bolt can be absorbed. Moreover, since the second connection portion of the connection member and the second terminal are connected through the insertable/removable plug, and the inserting/removing direction of the plug and the axial direction of the fastening bolt are substantially parallel to each other, the errors regarding the dimensions of the connection member and the attachment positions of the first terminal and the second terminal in the axial direction of the fastening bolt can be absorbed by adjustment of the insertion amount of the plug. Thus, by using a simple structure, a load such as a bending stress can be prevented from being applied to the connection member due to the errors.

Moreover, since the inserting/removing direction of the plug and the axial direction of the fastening bolt are substantially parallel to each other, the working direction in the fastening work of the fastening bolt substantially matches the inserting/removing direction of the plug. This can facilitate the connecting work of the connection member, and thus, can improve workability. Moreover, since the connection member is fixed in the inserting/removing direction of the plug by the fastening bolt, the second connection portion and the second terminal can be prevented from coming off from the plug due to vibration or the like, without separately providing a special structure.

An inserting direction of the fastening bolt may be substantially the same as a supplying direction of the second connection portion when connecting the second connection portion to the second terminal through the plug.

According to this structure, the connecting work of the second connection portion and the second terminal through the plug, and the inserting work of the fastening bolt can be performed from the same direction, whereby the workability can further be improved.

Moreover, the connection member may have a bent portion provided between the first connection portion and the second connection portion so that an extending direction of the first connection portion and an extending direction of the second connection portion become substantially perpendicular to each other.

According to this structure, the axial direction of the fastening bolt can be made substantially parallel to the extending direction of the second connection portion by setting the axial direction of the fastening bolt to a direction perpendicular to the extending direction of the first connection portion in a plane including the first connection portion. Thus, in the structure in which the second connection portion is inserted into and removed from the plug, the inserting/removing direction of the plug and the axial direction of the fastening bolt can be made substantially parallel to each other by merely designing an installation angle of the fastening bolt in the manner described above. Moreover, in the structure in which the plug is fixed to the second connection portion, the inserting/removing direction of the plug and the axial direction of the fastening bolt can be made substantially parallel to each other by merely fixing the plug to the second connection portion so that the extending direction of the second connection portion and the inserting/removing direction of the plug become parallel to each other, in addition to designing the installation angle of the fastening bolt in the manner described above. Moreover, in the case where both the second connection portion and the second terminal are structured to be insertable into and removable from the plug, the inserting/removing direction of the plug and the axial direction of the fastening bolt can be made substantially parallel to each other by merely structuring the plug so that the respective inserting/removing directions of the second connection portion and the second terminal into/from the plug become parallel to each other.

Moreover, the first connection portion and the plug may be positioned so as to overlap each other in the axial direction of the fastening bolt.

According to this structure, a connection portion between the first connection portion and the first terminal by the fastening bolt is positioned so as to overlap the plug in the axial direction of the fastening bolt. Thus, the length of a space occupied by the fastening bolt in the axial direction of the fastening bolt, the plug, and the connection member can be reduced. Accordingly, an increase in occupied space of the electrical connection structure can be suppressed.

Moreover, the extending direction of the first connection portion may be substantially parallel to an extending direction of the first terminal, and the extending direction of the second connection portion be substantially parallel to an extending direction of the second terminal.

According to this structure, since the extending direction of the first connection portion is substantially parallel to the extending direction of the first terminal, the fastening structure and the fastening work in the connection portion between the first connection portion and the first terminal can be simplified. Moreover, since the extending direction of the second connection portion is substantially parallel to the extending direction of the second terminal, the structure of the plug for connecting the second connection portion and the second terminal can be simplified.

Moreover, the plug may be fixed to the second terminal, and the second connection portion be structured to be insertable into and removable from the plug.

According to this structure, since the plug having a certain degree of weight is not fixed to the second connection portion that is a tip of the connection member, the connection member can be prevented from vibrating when vibration is transmitted to the connection member. Thus, a reduction in vibration resistance of the connection member can be suppressed.

Moreover, the first connection portion and the first terminal may be fixedly fastened by the fastening bolt in a state where the first connection portion overlaps a rear side of the first terminal with respect to the supplying direction of the second connection portion when connecting the second connection portion to the second terminal through the plug.

According to this structure, since the supplying direction of the second connection portion when connecting the second connection portion to the second terminal through the plug, and a supplying direction of the first connection portion when connecting the first connection portion to the first terminal through the fastening bolt match each other, workability of the connecting work can further be improved.

Moreover, a diameter of the insertion hole may be set so that a difference between the diameter of the insertion hole and the diameter of the shaft-like portion of the fastening bolt becomes larger than an integrated value of tolerances of attachment positions of the first terminal and the second terminal, and a dimensional tolerance of the connection member, in a direction that is parallel to a plane perpendicular to an axis of the fastening bolt.

Errors in the direction that is parallel to the plane perpendicular to the axial direction of the fastening bolt are caused by errors of the attachment positions of the first terminal and the second terminal in this plane, and a dimensional error of the connection member in this plane. Moreover, these errors should fall within the range of tolerances that are set in advance according to the processing accuracy of a processing machine, the processing cost, and the like. According to this structure, errors in the direction that is parallel to the plane perpendicular to the axial direction of the fastening bolt can be absorbed accurately.

Moreover, the connection member may be a plate-like body made of a conductive material.

According to this structure, in the case where the connection member has a bent portion, the difficulty of the work of forming the bent portion can be reduced. Moreover, the use of the plate-like body as the connection member can increase the ratio of the surface area to the volume, as compared to the case where the connection member has a square prism shape or a cylindrical shape. Thus, electrical contact in the first connection portion and the second connection portion can be sufficiently ensured.

Moreover, the first terminal, the second terminal, and the connection member may be accommodated in a case having an opening, and the inserting direction of the fastening bolt be set so that the opening is positioned rearward in the inserting direction.

In general, the inserting direction of the fastening bolt matches a working direction in the fastening work of the fastening bolt. According to this structure, in the case where the first terminal, the second terminal, and the connection member are accommodated in the case having the opening, a tool required for the fastening work can be inserted through the opening positioned rearward in the inserting direction of the fastening bolt. Thus, workability can be sufficiently improved.

Moreover, the first terminal may be connected to a rotating electrical machine, the second terminal be connected to an inverter unit for controlling the rotating electrical machine, and the first terminal, the second terminal, and the connection member be accommodated in the case, together with the inverter unit.

In such a structure, the first terminal and the second terminal need be connected in the case. In general, however, predetermined errors may be generated in the attachment positions of the terminals that are connected to the rotating electrical machine and the inverter unit. According to this structure, errors regarding the attachment position of each terminal can be absorbed even in a device using such instruments.

DETAILED DESCRIPTION OF EMBODIMENTS

Figure 1:
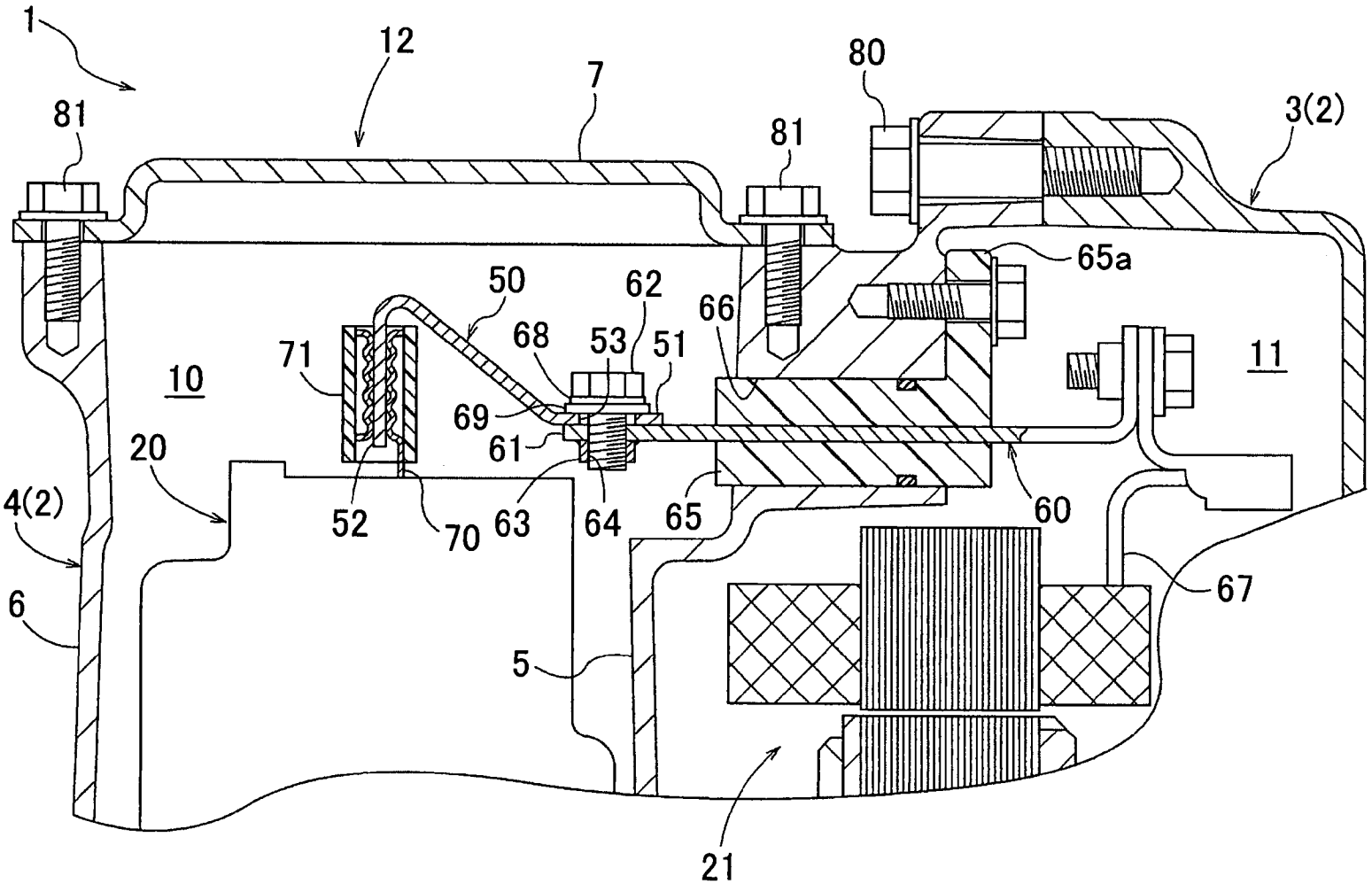
FIG. 1 is a partial cross-sectional view of a drive device according to an embodiment of the present invention.
Figure 2:
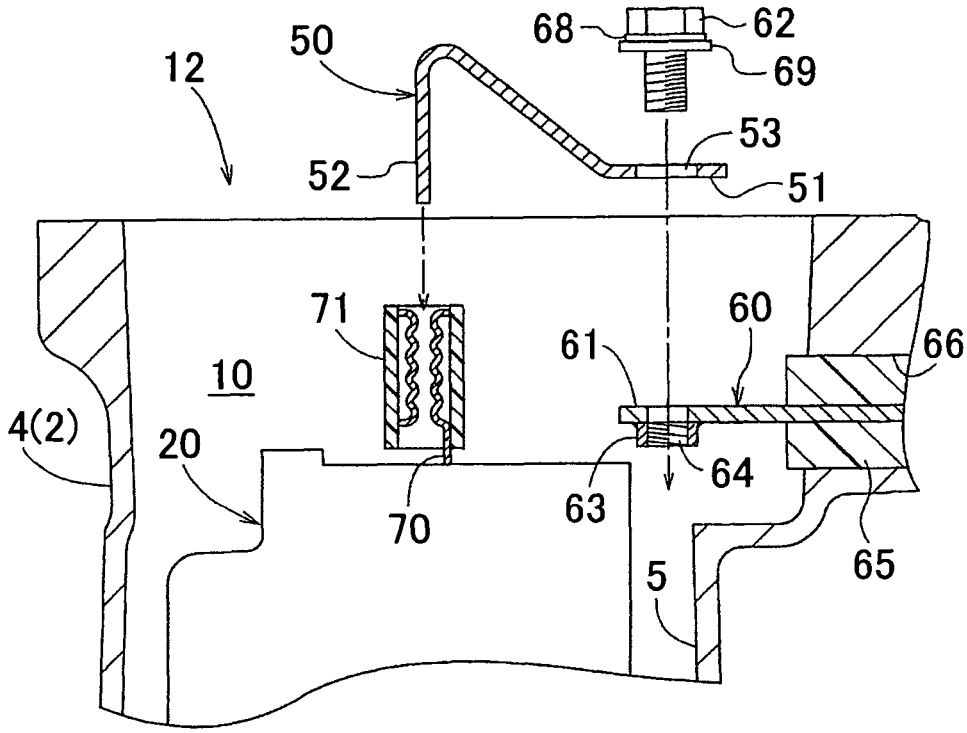
FIG. 2 is an exploded cross-sectional view of a bus bar connection portion according to the embodiment of the present invention.
Figure 3A:
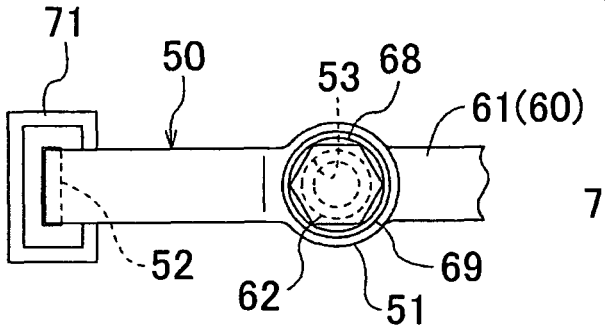
FIGS. 3A and 3B show a top view and an exploded perspective view of main members of an electrical connection structure.
Figure 3B:
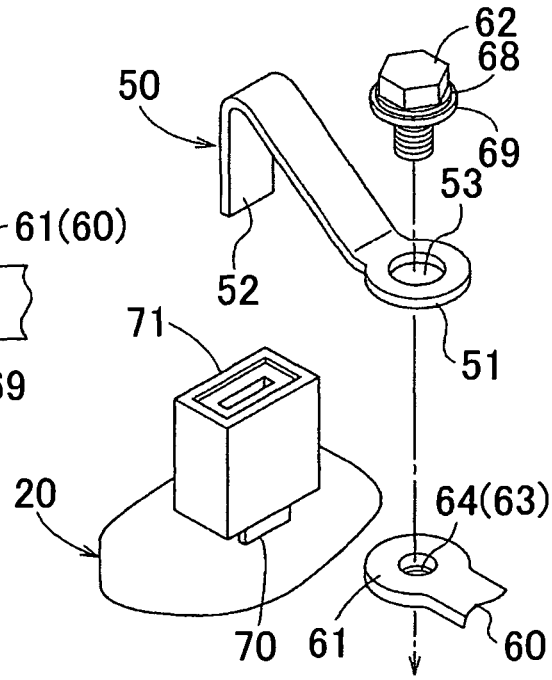

Hereinafter, an embodiment of an electrical connection structure according to the present invention will be described with reference to the accompanying drawings. The present embodiment will be described with respect to an example in which the electrical connection structure of the present invention is applied to an electrical connection portion between a rotating electrical machine 21 and an inverter unit 20 in a vehicle drive device 1. FIG. 1 is a partial cross-sectional view of the drive device 1 according to the present embodiment, and FIG. 2 is an exploded cross-sectional view of a connection portion where a bus bar 50 is connected in the drive device 1. FIGS. 3A and 3B show a top view and an exploded perspective view of main members of the electrical connection structure. Note that, in the present embodiment, the bus bar 50 corresponds to a "connection member" in the present invention.

As shown in these drawings, in the drive device 1 according to the present embodiment, the rotating electrical machine 21 and the inverter unit 20 are accommodated in a drive device case 2, which is a case of the drive device 1, and a first terminal 61 electrically connected to the rotating electrical machine 21 and a second terminal 70 electrically connected to the inverter unit 20 are electrically connected to each other by the bus bar 50. The structure of the drive device case 2 and the structure of the electrical connection structure will be described sequentially below. Note that, in the present embodiment, the direction from top to bottom in FIG. 1 substantially matches a vertical direction in the state where the drive device 1 is mounted on a vehicle (hereinafter simply referred to as the "vehicle mounted state"), and the left-right direction substantially matches a horizontal direction in the vehicle mounted state. Moreover, in the following description, "upper" indicates the upper side in FIG. 1, "lower" indicates the lower side in FIG. 1, "left" indicates the left side in FIG. 1, and "right" indicates the right side in FIG. 1, unless otherwise specified. Note that, it is to be understood that the present invention may also be applied to a structure in which the direction from top to bottom in FIG. 1 does not match the vertical direction in the vehicle mounted state, and a structure in which the left-right direction in FIG. 1 does not match the horizontal direction in the vehicle mounted state.

1. Structure of the Drive Device Case

As shown in FIG. 1, the rotating electrical machine 21 as a driving force source of a vehicle, and the inverter unit 20 for controlling the rotating electrical machine 21 are accommodated in the drive device case 2 of the drive device 1 of the present embodiment. Note that FIG. 1 shows only a portion that is required to illustrate the electrical connection structure of the present invention. Another rotating electrical machine, and a drive transmission mechanism formed by a planetary gear unit and the like, may be included in a portion not shown in the drawing.

In the present embodiment, the drive device case 2 integrally accommodates the rotating electrical machine 21 and the inverter unit 20, and is structured to be dividable into a motor case 3 and an inverter case 4. Note that, in the present embodiment, the inverter case 4 corresponds to a "case" in the present invention. Moreover, a sidewall 5 of the inverter case 4 has a plurality of bolt insertion holes. The inverter case 4 is fixedly fastened to the motor case 3 by a plurality of case attachment bolts 80 inserted in the respective bolt insertion holes. Moreover, the inverter case 4 has an opening 12 on top, and a cover 7 as a lid member for covering the opening is attached to the opening 12. The cover 7 is fixedly fastened to the inverter case 4 by a plurality of cover attachment bolts 81.

Since the drive device case 2 is structured in the manner described above, a motor accommodating chamber 11 for accommodating the rotating electrical machine 21 is formed in the motor case 3, and an accommodating space 10 for accommodating the inverter unit 20 is formed in the inverter case 4. As shown in FIG. 1, the motor accommodating chamber 11 and the accommodating space 10 are separated from each other by the sidewall 5 of the inverter case 4. Note that, although not shown in the drawing, the motor accommodating chamber 11 and the accommodating space 10 are separated from each other by the sidewall 5 also in a portion not shown in FIG. 1, so as not to communicate with each other except in a portion where a conductor plate insertion hole 66 described below is positioned.

The rotating electrical machine 21 is accommodated in the motor accommodating chamber 11 provided in the motor case 3. A connection wiring 67 extended from a coil end of a stator of the rotating electrical machine 21 is fixedly fastened to a conductor plate 60 by a bolt. Note that, in the present embodiment, the conductor plate 60 is a plate-like member made of a conductive material such as copper. The conductor plate 60 is provided in a form that extends through the sidewall 5 of the inverter case 4, in order to enable electrical connection between the rotating electrical machine 21 and the inverter unit 20.

The conductor plate insertion hole 66 for inserting the conductor plate 60 therethrough is formed in the sidewall 5 of the inverter case 4. In the present embodiment, three conductor plates 60 are required since the rotating electrical machine 21 is a three-phase alternating current (AC) electric motor. Thus, three conductor plate insertion holes 66 are formed in the sidewall 5. FIG. 1 shows one of the three conductor plate insertion holes 66, and the remaining two conductor plate insertion holes are formed on the side closer to the viewer, or on the side farther away from the viewer. Note that, in the case where the drive device case 2 further includes another rotating electrical machine in addition to the rotating electrical machine 21, six conductor plates 60 are required, and six conductor plate insertion holes 66 are formed in the sidewall 5. Note that each conductor plate insertion hole 66 is formed as a circular hole according to the cross-sectional shape of an insulating member 65 described below, which is provided so as to surround the periphery of the conductor plate 60.

As shown in FIG. 1, the conductor plate 60 is positioned so as to extend through the sidewall 5 of the inverter case 4 in a direction (the left-right direction in FIG. 1) substantially perpendicular to an axial direction of a fastening bolt 62 described below. Moreover, the outer periphery of the conductor plate 60 is covered by the insulating member 65 in a portion extending through the sidewall 5. The insulating member 65 is herein formed in a cylindrical shape in a portion extending through the sidewall 5, and a flange portion 65*a* is formed at an end of the motor accommodating chamber 11 side of the insulating member 65. The cylindrical portion of the insulating member 65 is inserted through the conductor plate insertion hole 66 formed in the sidewall 5, and the flange portion 65*a* is fixedly fastened to the sidewall 5 by a fastening member such as a bolt. Thus, the conductor plate 60 held in the insulating member 65 is fixed to the sidewall 5. The insulating member 65 is made of a highly electrically insulating material. Moreover, an O-ring as a seal member is disposed between the insulating member 65 and the sidewall 5. Thus, the outer peripheral surface of the insulating member 65 and the inner peripheral surface of the conductor plate insertion hole 66 are sealed liquid-tight, whereby oil, which is present in the motor accommodating chamber 11, is prevented from entering the accommodating space 10.

Moreover, the first terminal 61 for attaching the bus bar 50 described below is provided at a tip of the conductor plate 60 on the accommodating space 10 side.

On the other hand, the inverter unit 20 is accommodated in the accommodating space 10 provided in the inverter case 4. The inverter unit 20 functions as an inverter for controlling the rotating electrical machine 21 by controlling AC electric power to be supplied to the rotating electrical machine 21 as a three-phase AC electric motor. Although not shown in the drawing, in the present embodiment, the inverter unit 20 is formed by integrally assembling a switching element module which is positioned in an upper portion, and a reactor and a capacitor which are positioned in a lower portion.

Moreover, the inverter unit 20 includes the second terminal 70 that protrudes upward. The second terminal 70 is a terminal for electrically connecting to the rotating electrical machine 21. Like the first terminal 61, the second terminal 70 is a plate-like member made of a conductive material such as copper. Thus, the inverter unit 20 includes three second terminals 70 that are respectively connected to three-phase coils of U-phase, V-phase, and W-phase of the rotating electrical machine 21. Note that FIG. 1 shows one of the three second terminals 70. Each of the second terminals 70 is connected to a corresponding one of the first terminals 61 through a corresponding bus bar 50. Note that, in the case where the drive device case 2 further includes another rotating electrical machine in addition to the rotating electrical machine 21, the inverter unit 20 includes six second terminals.

2. Structure of the Electrical Connection Structure

As described above, in the present embodiment, the first terminals 61 electrically connected to the rotating electrical machine 21, the second terminals 70 electrically connected to the inverter unit 20, and the inverter unit 20 are accommodated in the accommodating space 10 provided in the inverter case 4 having the opening 12. Moreover, the first terminals 61 and the second terminals 70 are electrically connected to each other through the bus bars 50, whereby the rotating electrical machine 21 and the inverter unit 20 are electrically connected. The structure of the electrical connection structure in which the bus bar 50 is attached will be described below. Note that a plurality of such connection structures using the bus bars 50 are provided according to the number of the first terminals 61 and the second terminals 70. However, since there is no significant difference between the connection structures, the connection structure regarding the first terminal 61 and the second terminal 70 shown in the cross-sectional view of FIG. 1 will be described below.

In the present embodiment, the bus bar 50 as a connection member is a plate-like body made of a conductive material such as copper. A first connection portion 51, which is connected to the first terminal 61, is formed in an end of the bus bar 50 on the motor accommodating chamber 11 side, that is, on the sidewall 5 side. On the other hand, a second connection portion 52, which is connected to the second terminal 70, is formed in an end of the bas bar 50 on the opposite side to the motor accommodating chamber 11, that is, on the sidewall 6 side. As shown in FIGS. 1 through 3, the extending direction of the first connection portion 51 and the extending direction of the second connection portion 52 are substantially perpendicular to each other.

As shown in FIG. 1, the extending direction of the first terminal 61 and the extending direction of the first connection portion 51 are substantially parallel to each other, and the first connection portion 51 and the first terminal 61 are fixedly fastened in the up-down direction by the fastening bolt 62. By fixedly fastening the first connection portion 51 and the first terminal 61 in this manner, the extending direction of the first connection portion 51 becomes substantially perpendicular to the axial direction of the fastening bolt 62. Moreover, since the extending direction of the first connection portion 51 and the extending direction of the second connection portion 52 are substantially perpendicular to each other as described above, the extending direction of the second connection portion 52 becomes substantially parallel to the axial direction of the fastening bolt 62. Moreover, since the fastening bolt 62 is provided so as to be fastened from upward to downward, the fastening work can be performed from the opening 12. More specifically, a fastening hole 64 for screwing the fastening bolt 62 therein is provided in the first terminal 61, and an insertion hole 53 for inserting the fastening bolt 62 therethrough is provided in the first connection portion 51 of the bus bar 50 that is disposed on the first terminal 61. Thus, the first connection portion 51 and the first terminal 61 are fixedly fastened by inserting the fastening bolt 62, together with a spring washer 68 and a plain washer 69, into the insertion hole 53 of the first connection portion 51 from above, and screwing the fastening bolt 62 in the first fastening hole 64 of the first terminal 61.

In the present embodiment, the fastening hole 64 is provided in the first terminal 61 by providing a nut 63, which has the fastening hole 64 as a female screw portion, integrally with the first terminal 61 by welding or the like. Note that the fastening hole 64 may be integrally provided in the first terminal 61 by burring and tapping the first terminal 61.

As shown in FIGS. 1 through 3, the insertion hole 53 provided in the first connection portion 51 has a diameter larger than that of an shaft-like portion of the fastening bolt 62. More specifically, the diameter of the insertion hole 53 is set so that the difference in diameter between the insertion hole 53 and the shaft-like portion of the fastening bolt 62 is larger than an integrated value of the tolerances of the attachment positions of the first terminal 61 and the second terminal 70, and the dimensional tolerance of the bus bar 50, in a direction that is parallel to a plane perpendicular to an axis of the fastening bolt 62. Note that the tolerances of the attachment positions of the first terminal 61 and the second terminal 70 are determined based on the tolerances set for each portion that affects the attachment position of the conductor plate 60 with respect to the sidewall 5 of the inverter case 4, the dimensions of the conductor plate 60, the attachment position of the inverter unit 20, the position of the second terminal 70 with respect to an attachment portion of the inverter unit 20, and the like. Moreover, the dimensional tolerance of the bus bar 50 is determined based on the tolerance set for the distance between the center of the insertion hole 53 and the second connection portion 52. Thus, errors of the attachment positions of the first terminal 61 and the second terminal 70 in the above direction, and a dimensional error of the bus bar 50 in the above direction can be absorbed by adjustment of the positional relationship between the insertion hole 53 and the fastening bolt 62. Note that, according to the tolerances of the attachment position and the dimensions, the diameter of the insertion hole 53 can be changed as appropriate in a range that does not exceed the outer diameter of the plain washer 69. Moreover, in the case where the tolerances are not uniform in a circumferential direction, for example, an insertion hole 53 whose inner diameter is not uniform in the circumferential direction, such as an elongated hole or an elliptical hole, may be provided in the first connection portion 51.

The second connection portion 52, which is the end of the opposite side to the side connected to the first terminal 61 in the bus bar 50, is connected to the second terminal 70 through an insertable/removable plug 71. Note that, in the present embodiment, as shown in FIGS. 1 and 2, the extending direction of the second terminal 70 and the extending direction of the second connection portion 52 are substantially parallel to each other. The plug 71 is a member that is structured so that the member can be connected and separated by insertion and removal with respect to a terminal to be connected (the second connection portion 52 in the present embodiment). Moreover, in the present embodiment, as shown in FIGS. 1 through 3, the plug 71 is fixed to the second terminal 70 in a form in which a terminal in the plug 71 and the second terminal 70 are electrically connected, and the inserting/removing direction is substantially parallel to the extending direction of the second connection portion 52. Since the extending direction of the second connection portion 52 is substantially parallel to the axial direction of the fastening bolt 62 as described above, the inserting/removing direction of the plug 71 is substantially parallel to the axial direction of the fastening bolt 62. Thus, errors of the attachment positions of the first terminal 61 and the second terminal 70 and a dimensional error of the bus bar 50 in the axial direction of the fastening bolt 62 can be absorbed by adjustment of the insertion amount of the second connection portion 52 into the plug 71.

Thus, since the inserting direction of the second connection portion 52 into the plug 71 is a downward direction along the axial direction of the fastening bolt 62, in the present embodiment, connection between the first connection portion 51 and the first terminal 61 is fixedly fastened by the fastening bolt 62 in the state where the first connection portion 51 overlaps the rear side (the upper side) of the first terminal 61 with respect to the inserting direction of the second connection portion 52 into the plug 71 (the direction from upward to downward). Moreover, in the present embodiment, the direction from the opening 12 toward the accommodating space 10 in the inverter case 4 matches the inserting direction of the second connection portion 52 into the plug 71, which is the direction from upward to downward. Thus, the supplying direction of the bus bar 50 to an attachment position thereof, and the inserting direction of the second connection portion 52 into the plug 71 match each other, and this direction also matches the direction from the opening 12 toward the inside of the inverter case 4.

Moreover, in the present embodiment, in order to reduce the length in the up-down direction of a space occupied by the electrical connection structure, the first connection portion 51 and the plug 71 are positioned so as to overlap each other in the axial direction of the fastening bolt 62 in the state where the bus bar 50 is attached, as shown in FIG. 1. Thus, two bent portions are provided between the first connection portion 51 and the second connection portion 52 in the bus bar 50. More specifically, as shown in FIGS. 1 through 3, the bus bar 50 has the first connection portion 51 that is disposed parallel to a plane substantially perpendicular to the axial direction of the fastening bolt 62, an inclined portion that is inclined from the first connection portion 51 toward the second connection portion 52 in an opposite direction (upward in the present embodiment) to the inserting direction of the second connection portion 52 into the plug 71, and the second connection portion 52 that extends from an end of the inclined portion on the second connection portion 52 side in the inserting direction of the second connection portion 52 into the plug 71 (downward in the present embodiment).

As described above, in the present embodiment, as shown in FIG. 2, all of the supplying direction of the bus bar 50 to the attachment portion thereof, the inserting direction of the second connection portion 52 into the plug 71, the inserting direction of the fastening bolt 62 into the insertion hole 53, and the fastening direction of the fastening bolt 62 match the direction from upward to downward, and this direction also matches the direction from the outside of the inverter case 4 toward the accommodating space 10. Thus, all the attaching work of the bus bar 50 can be easily performed from the opening 12 provided on top. Moreover, since the second connection portion 52 of the bus bar 50 is held by the plug 71 when fastening the fastening bolt 62, the position of the bus bar 50 becomes stable during the fastening work, whereby the fastening work is facilitated.

Figure 4:
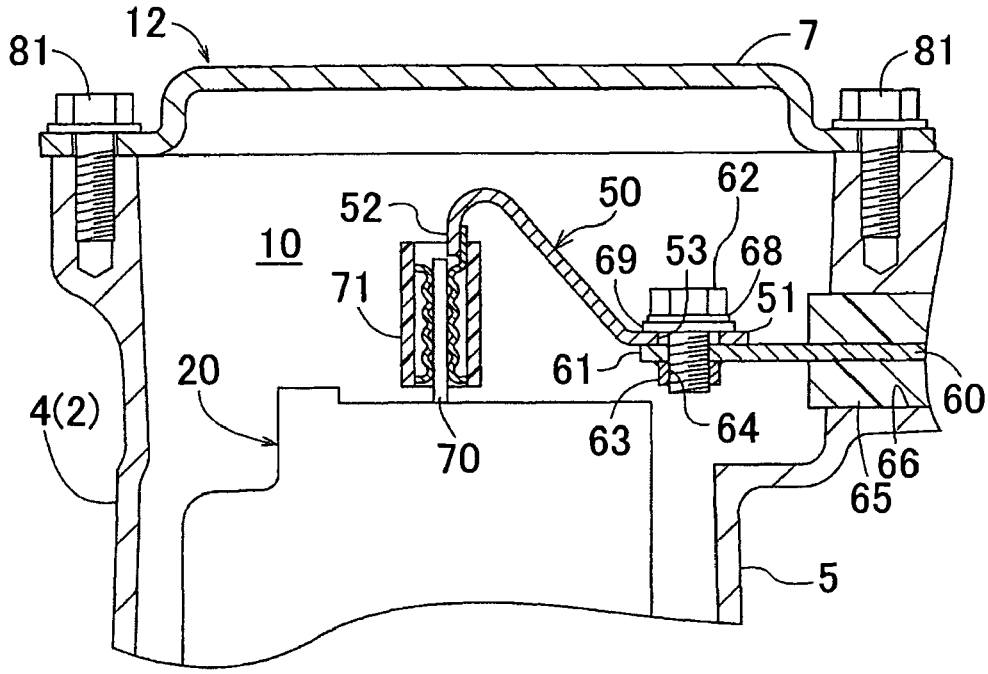
FIG. 4 is a cross-sectional view of a bus bar connection portion according to other embodiment of the present invention.

Other Embodiments (1) The above embodiment has been described with respect to an example in which the plug 71 is fixed to the second terminal 70, and the second connection portion 52 is structured to be insertable into and removable from the plug 71. However, embodiments of the present invention are not limited to this. That is, as shown in FIG. 4, it is also one of preferred embodiments of the present invention that the plug 71 be fixed to the second connection portion 52, and the second terminal 70 be structured to be insertable into and removable from the plug 71. Alternatively, both the second connection portion 52 and the second terminal 70 may be structured to be insertable into and removable from the plug 71.

(2) The above embodiment has been described with respect to an example in which the bus bar 50 as a connection member is a plate-like body. However, embodiments of the present invention are not limited to this. That is, a connection member of any shape may be used as long as the first connection portion 51 at one end of the bus bar 50 can be fixed to the first terminal 61 by the fastening bolt 62, and the second connection portion 52 at the other end of the bus bar 50 can be connected to the second terminal 70 through the plug 71. For example, a member, which has a square prism shape or a cylindrical shape and is made of a conductive material, may be used as the connection member.

(3) The above embodiment has been described with respect to an example in which the diameter of the insertion hole 53 is set so that the difference in diameter between the insertion hole 53 and the shaft-like portion of the fastening bolt 62 is larger than an integrated value of the tolerances of the attachment positions of the first terminal 61 and the second terminal 70, and the dimensional tolerance of the bus bar 50, in the direction that is parallel to the plane perpendicular to the axis of the fastening bolt 62. However, embodiments of the present invention are not limited to this. That is, it is also one of preferred embodiments of the present invention that the difference in diameter between the insertion hole 53 and the shaft-like portion of the fastening bolt 62 be smaller than the above integrated value. For example, in the case where the bus bar 50 is formed by a flexible member, the difference in diameter between the insertion hold 53 and the shaft-like portion of the fastening bolt 62 may be smaller than the above integrated value.

Figure 5:
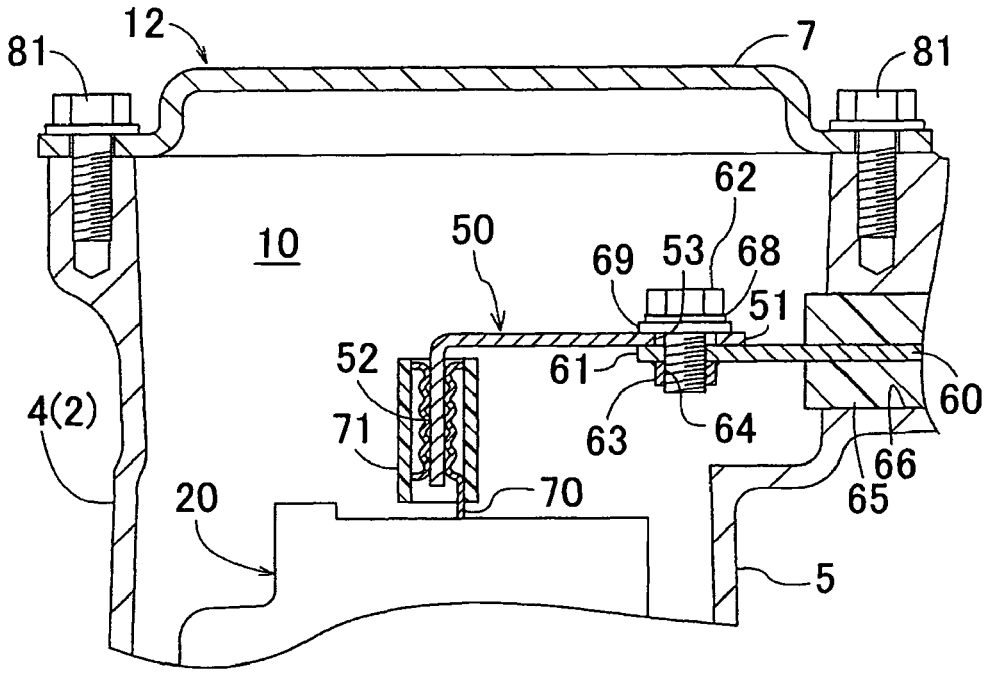
FIG. 5 is a cross-sectional view of a bus bar connection portion according to other embodiment of the present invention.

(4) The above embodiment has been described with respect to an example in which the first connection portion 51 and the plug 71 are positioned so as to overlap each other in the axial direction of the fastening bolt 62 in the state where the bus bar 50 is attached. However, embodiments of the present invention are not limited to this. That is, it is also one of preferred embodiments of the present invention that the first connection portion 51 and the plug 71 be positioned so as not to overlap each other in the axial direction of the fastening bolt 62. For example, as shown in FIG. 5, the plug 71 may be provided at a position lower than the first connection portion 51. In this case, the bus bar 50 can have one bent portion, whereby the manufacturing process of the bus bar 50 can be simplified.

Figure 6:
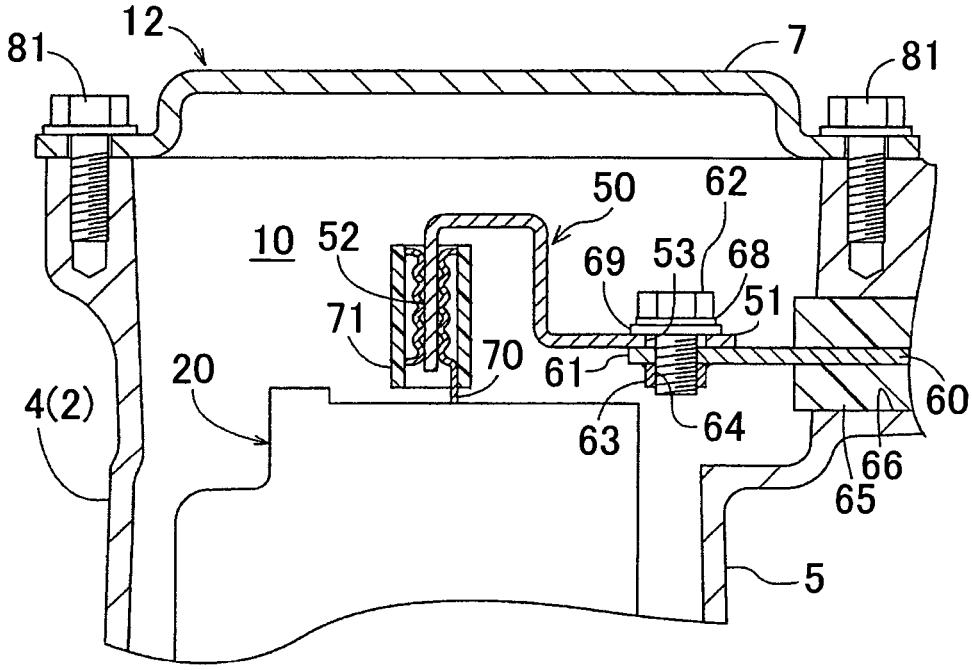
FIG. 6 is a cross-sectional view of a bus bar connection portion according to other embodiment of the present invention.

(5) The above embodiment has been described with respect to an example in which the bus bar 50 has the first connection portion 51 that is disposed parallel to the plane substantially perpendicular to the axial direction of the fastening bolt 62, the inclined portion that is inclined from the first connection portion 51 toward the second connection portion 52 in the opposite direction to the inserting direction of the second connection portion 52 into the plug 71, and the second connection portion 52 that extends from the end of the second connection portion 52 side of the inclined portion in the inserting direction of the second connection portion 52 into the plug 71. However, embodiments of the present invention are not limited to this. That is, as shown in, for example, FIG. 6, it is also one of preferred embodiments of the present invention that the bus bar 50 have three bent portions, and be bent in a substantially U-shape. In this structure as well, the first connection portion 51 and the plug 71 can be positioned to overlap each other in the axial direction of the fastening bolt 62 in the state where the bus bar 50 is attached, whereby the length in the up-down direction of the space occupied by the electrical connection structure can be reduced.

Figure 7:
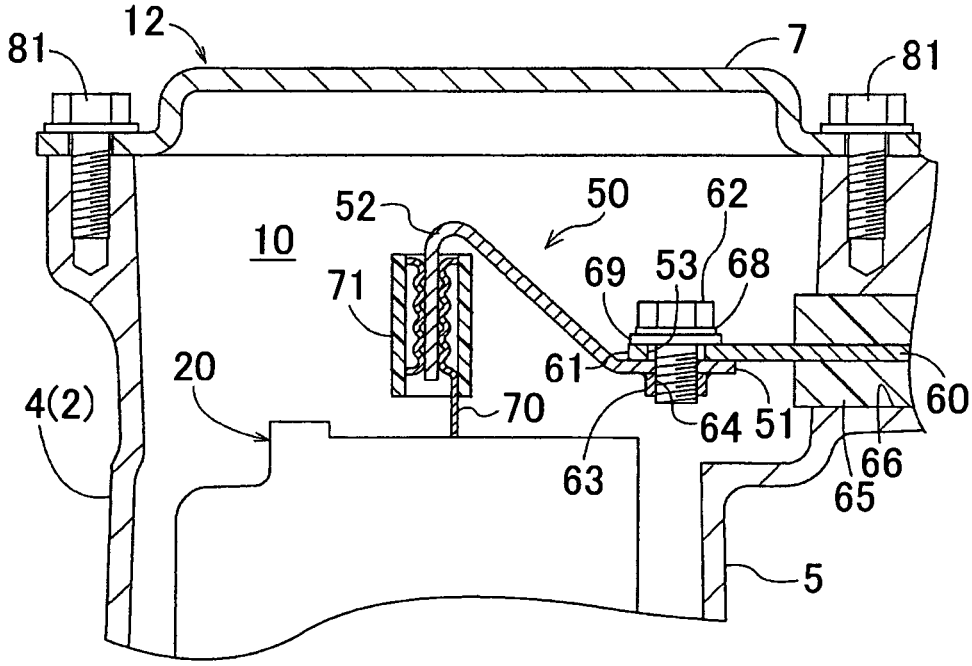
FIG. 7 is a cross-sectional view of a bus bar connection portion according to other embodiment of the present invention.

(6) The above embodiment has been described with respect to an example in which the first connection portion 51 and the first terminal 61 are fixedly fastened by the fastening bolt 62 in the state where the first connection portion 51 overlaps the rear side of the first terminal 61 with respect to the inserting direction of the second connection portion 52 into the plug 71, that is, the supplying direction of the second connection portion 52 when connecting the second connection portion 52 to the second terminal 70 through the plug 71. However, embodiments of the present invention are not limited to this. That is, as shown in FIG. 7, it is also one of preferred embodiments of the present invention that the first connection portion 51 and the first terminal 61 be fixedly fastened by the fastening bolt 62 in the state where the first connection portion 51 overlaps the front side of the first terminal 61 with respect to the inserting direction of the second connection portion 52 into the plug 71. In this case, the fastening hole 64 for screwing the fastening bolt 62 therein may be provided in the first connection portion 51 of the bus bar 50, and the insertion hole 53 for inserting the fastening bolt 62 therethrough may be provided in the first terminal 61. This embodiment can be preferably implemented, for example, in the case where the inverter case 4 further has an opening at the bottom. That is, in the case where the inverter case 4 further has an opening at the bottom, the inverter unit 20 can be inserted into the inverter case 4 from this opening, and can be assembled upward. In this case, if the bus bar 50 is inserted in advance into the plug 71, the work that is performed from the opening 12 on top after the inverter unit 20 is assembled is only fastening of the fastening bolt 62, whereby the work that is performed from the opening 12 on top can be simplified.

(7) The above embodiment has been described with respect to an example in which the extending direction of the first connection portion 51 and the extending direction of the second connection portion 52 are substantially perpendicular to each other. However, embodiments of the present invention are not limited to this. For example, it is also one of preferred embodiments of the present invention that the extending direction of the first connection portion 51 and the extending direction of the second connection portion 52 be substantially parallel to each other. For example, in the case where both the extending direction of the first connection portion 51 and the extending direction of the second connection portion 52 are the left-right direction, the plug 71 may be fixed to the lower surface of the second connection portion 52 so that the inserting/removing direction becomes the up-down direction, and the second connection portion 52 having the plug 71 fixed thereto may be moved from upward to downward toward the second terminal 70 so that the second terminal 70 is inserted into the plug 71.

(8) The above embodiment has been described with respect to an example in which the extending direction of the first terminal 61 and the extending direction of the first connection portion 51 are substantially parallel to each other, and the extending direction of the second terminal 70 and the extending direction of the second connection portion 52 are substantially parallel to each other. However, embodiments of the present invention are not limited to this. That is, the relationship of the extending direction of each member is not limited to the above example, as long as the first terminal 61 and the first connection portion 51 can be fixedly fastened by the fastening bolt 62, and the second terminal 70 and the second connection portion 52 can be connected through the plug 71. For example, it is also one of preferred embodiments of the present invention that, in FIG. 1, the plug 71 be fixed to the second terminal 70 so that the extending direction of the second terminal 70 becomes the left-right direction, and the inserting/removing direction becomes substantially parallel to the up-down direction.

(9) The above embodiment has been described with respect to an example in which the inserting direction of the fastening bolt 62 is substantially the same as the supplying direction of the second connection portion 52 when connecting the second connection portion 52 to the second terminal 70 through the plug 71, that is, the fastening bolt 62 is fastened from upward to downward. However, embodiments of the present invention are not limited to this. That is, it is also one of preferred embodiments of the present invention that, in the case where there is a space for the fastening work under the first terminal 61, the inserting direction of the fastening bolt 62 be a direction opposite to the supplying direction of the second connection portion 52, so that the fastening bolt 62 is fastened from downward to upward. It is also one of preferred embodiments of the present invention that the axial direction of the fastening bolt 62 be a direction other than the up-down direction, and the inserting/removing direction of the plug 71 be substantially parallel to this direction.

(10) The above embodiment has been described with respect to an example in which the first terminal 61, the second terminal 70, and the bus bar 50 are accommodated in the inverter case 4 having the opening 12, and the opening 12 is positioned rearward in the inserting direction of the fastening bolt 62. However, embodiments of the present invention are not limited to this. That is, it is also one of preferred embodiments of the present invention that the opening 12 be located at a position other than the rearward position in the inserting direction of the fastening bolt 62, or that no opening 12 be provided. Moreover, the first terminal 61, the second terminal 70, and the bus bar 50 may be exposed to the outside of the case.

(11) The above embodiment has been described with respect to an example in which the first terminal 61 is connected to the rotating electrical machine 21, and the second terminal 70 is connected to the inverter unit 20. However, embodiments of the present invention are not limited to this. That is, it is also one of preferred embodiments of the present invention that the first terminal 61 be connected to the inverter unit 20, and the second terminal 70 be connected to the rotating electrical machine 21.

(12) The above embodiment has been described with respect to an example in which the present invention is applied to an electrical connection portion between the rotating electrical machine 21 and the inverter unit 20 in the vehicle drive device 1. However, embodiments of the present invention are not limited to this. That is, the electrical connection structure of the present invention may be applied not only to vehicle drive devices, but also to all the devices and instruments having an electrical connection structure.

The present invention is preferably used in an electrical connection structure for electrically connecting a first terminal and a second terminal by a connection member.

What is claimed is:

1. An electrical connection structure for electrically connecting a first terminal and a second terminal by a connection member, wherein a first connection portion of the connection member is fixedly fastened to the first terminal by a fastening bolt, and a second connection portion of the connection member is connected to the second terminal through an insertable/removable plug, the first connection portion is fixedly fastened to the first terminal by inserting the fastening bolt through an insertion hole provided in one of the connection member and the first terminal, and fastening the fastening bolt in a fastening hole provided in the other of the connection member and the first terminal, the insertion hole is formed larger than a diameter of a shaft-like portion of the fastening bolt, and an inserting/removing direction of the plug and an axial direction of the fastening bolt are substantially parallel to each other.

2. The electrical connection structure according to claim 1, wherein an inserting direction of the fastening bolt is substantially the same as a supplying direction of the second connection portion when connecting the second connection portion to the second terminal through the plug.

3. The electrical connection structure according to claim 1, wherein the connection member has a bent portion provided between the first connection portion and the second connection portion so that an extending direction of the first connection portion and an extending direction of the second connection portion become substantially perpendicular to each other.

4. The electrical connection structure according to claim 1, wherein the first connection portion and the plug are positioned so as to overlap each other in the axial direction of the fastening bolt.

5. The electrical connection structure according to claim 1, wherein the extending direction of the first connection portion is substantially parallel to an extending direction of the first terminal, and the extending direction of the second connection portion is substantially parallel to an extending direction of the second terminal.

6. The electrical connection structure according to claim 1, wherein the plug is fixed to the second terminal, and the second connection portion is structured to be insertable into and removable from the plug.

7. The electrical connection structure according to claim 1, wherein the first connection portion and the first terminal are fixedly fastened by the fastening bolt in a state where the first connection portion overlaps a rear side of the first terminal with respect to the supplying direction of the second connection portion when connecting the second connection portion to the second terminal through the plug.

8. The electrical connection structure according to claim 1, wherein a diameter of the insertion hole is set so that a difference between the diameter of the insertion hole and the diameter of the shaft-like portion of the fastening bolt becomes larger than an integrated value of tolerances of attachment positions of the first terminal and the second terminal, and a dimensional tolerance of the connection member, in a direction that is parallel to a plane perpendicular to an axis of the fastening bolt.

9. The electrical connection structure according to claim 1, wherein the connection member is a plate-like body made of a conductive material.

10. The electrical connection structure according to claim 1, wherein the first terminal, the second terminal, and the connection member are accommodated in a case having an opening, and the inserting direction of the fastening bolt is set so that the opening is positioned rearward in the inserting direction.

11. The electrical connection structure according to claim 10, wherein the first terminal is connected to a rotating electrical machine, the second terminal is connected to an inverter unit for controlling the rotating electrical machine, and the first terminal, the second terminal, and the connection member are accommodated in the case, together with the inverter unit.

12. The electrical connection structure according to claim 2, wherein the connection member has a bent portion provided between the first connection portion and the second connection portion so that an extending direction of the first connection portion and an extending direction of the second connection portion become substantially perpendicular to each other.

13. The electrical connection structure according to claim 12, wherein the first connection portion and the plug are positioned so as to overlap each other in the axial direction of the fastening bolt.

14. The electrical connection structure according to claim 13, wherein the extending direction of the first connection portion is substantially parallel to an extending direction of the first terminal, and the extending direction of the second connection portion is substantially parallel to an extending direction of the second terminal.

15. The electrical connection structure according to claim 14, wherein the plug is fixed to the second terminal, and the second connection portion is structured to be insertable into and removable from the plug.

16. The electrical connection structure according to claim 15, wherein the first connection portion and the first terminal are fixedly fastened by the fastening bolt in a state where the first connection portion overlaps a rear side of the first terminal with respect to the supplying direction of the second connection portion when connecting the second connection portion to the second terminal through the plug.

17. The electrical connection structure according to claim 16, wherein a diameter of the insertion hole is set so that a difference between the diameter of the insertion hole and the diameter of the shaft-like portion of the fastening bolt becomes larger than an integrated value of tolerances of attachment positions of the first terminal and the second terminal, and a dimensional tolerance of the connection member, in a direction that is parallel to a plane perpendicular to an axis of the fastening bolt.

18. The electrical connection structure according to claim 17, wherein the connection member is a plate-like body made of a conductive material.

19. The electrical connection structure according to claim 18, wherein the first terminal, the second terminal, and the connection member are accommodated in a case having an opening, and the inserting direction of the fastening bolt is set so that the opening is positioned rearward in the inserting direction.

20. The electrical connection structure according to claim 19, wherein the first terminal is connected to a rotating electrical machine, the second terminal is connected to an inverter unit for controlling the rotating electrical machine, and the first terminal, the second terminal, and the connection member are accommodated in the case, together with the inverter unit.

* * * * *